US006439712B1

(12) United States Patent
Mizutani et al.

(10) Patent No.: US 6,439,712 B1
(45) **Date of Patent: *Aug. 27, 2002**

(54) INK LIQUID FIXING DEVICE AND INK JET RECORDING APPARATUS PROVIDED WITH SUCH INK LIQUID FIXING DEVICE

(75) Inventors: Michinari Mizutani, Tokyo; Yasuyuki Tamura, Yokohama, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/567,233

(22) Filed: Dec. 5, 1995

(30) Foreign Application Priority Data

Dec. 8, 1994 (JP) ..... 6-331140
Nov. 30, 1995 (JP) ..... 7-336215

(51) Int. Cl.[7] ..... B41J 2/01; H05B 1/00; H05B 11/00

(52) U.S. Cl. ..... 347/102; 219/216

(58) Field of Search ..... 347/102, 101; 392/417, 423; 49/388, 216; 34/266–267, 273, 611; 101/470, 471; 355/282, 285, 286, 287, 293, 30; 181/201, 202, 204; 346/25; 219/216

(56) References Cited

U.S. PATENT DOCUMENTS 4,340,893 A 7/1982 Ort ..... 347/102
4,740,796 A * 4/1988 Endo et al. ..... 347/56
5,005,025 A * 4/1991 Miyakawa et al. ..... 347/102
5,020,244 A 6/1991 Smith ..... 347/102
5,126,781 A * 6/1992 Tomizawa et al. ..... 355/27
5,296,873 A * 3/1994 Russell et al. ..... 347/102
5,317,127 A * 5/1994 Brewster, Jr. et al. ..... 219/388
5,864,352 A * 1/1999 Aoki et al. ..... 347/102

FOREIGN PATENT DOCUMENTS

JP 2251453 10/1990

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

An ink liquid fixing device used for an ink jet recording apparatus for discharging ink liquid onto a recording medium arranged on a given feeding path for the formation of images on the medium includes a housing, a first aperture for inducing air into the housing, a second aperture having a width wider than that of the recording medium arranged on the feeding path, this second aperture being arranged to face the recording surface of the recording medium arranged on the feeding path with given gaps formed between them on the upstream and downstream sides in the feeding direction thereof, a heat emitting source facing the recording surface of the recording medium through the second aperture side portions arranged around the heat emitting source, with the first aperture being arranged on one end and the second aperture on the other end thereof, and exhaust means for inducing the air outside the housing into the housing through the first aperture to guide the air to the recording surface of the recording medium by way of the heat emitting source and second aperture, and to exhaust the air outside the housing by forming the air flow through the aforesaid gaps toward the upstream and downstream sides in the feeding direction of the recording medium. Hence the prints on the recording medium are fixed rapidly at lower running costs.

27 Claims, 5 Drawing Sheets

INK LIQUID FIXING DEVICE AND INK JET RECORDING APPARATUS PROVIDED WITH SUCH INK LIQUID FIXING DEVICE

BACKGROUND OF THE INVENTION

1. Field of the Invention

The present invention relates to a so-called ink jet recording apparatus that discharges ink liquid from its orifices and causes it to adhere to a recording medium for the formation of images thereon. More particularly, the invention relates to an ink liquid fixing device for accelerating the fixation of the ink liquid that has adhered to a recording medium, and also, to an ink jet recording apparatus provided with such ink liquid fixing device.

2. Related Background Art

In recent years, there has been developed an ink jet recording apparatus that discharges ink (recording liquid) from its orifices (ink discharge ports) as liquid droplets and causes them to adhere to a recording medium (recording paper) for the formation of images thereon. This apparatus is not only capable of printing at high speeds at low costs, but also, capable of recording (printing) on an ordinary paper, besides such an advantage that the apparatus is easily made usable for the formation of images in colors. With these features and advantages, the future prosperity thereof is anticipated more than ever.

Ink absorption is slow when recording on an ordinary paper as compared to recording on a paper specially treated for a good ink absorption. The ink fixation should be accelerated by giving heat to such an ordinary recording paper. Particularly when images are recorded in colors, the amount of ink to be used is much greater than that of ink to be used for a monochromic recording. It is only natural that more time is required for the completion of the fixation. As a result, the acceleration of ink fixation is extremely important to make the time required for recording operation shorter by giving heat to the recording paper to accelerate the fixation of prints on it.

In general, therefore, it has been practiced to appropriately select for use either one of a hot plate heating method wherein a recording paper is in contact with a hot plate; a hot air heating method wherein hot air is blasted onto recording liquid; and a radiant heat method wherein a recording paper is heated by the application of radiant heat using an infrared heater.

Also, as an ink fixing apparatus, there is the one in which the hot air heating method and the radiant heat method are combined for use as disclosed in U.S. Pat. No. 5,020,244. However, this apparatus is designed to reduce the energy to be given to heating elements by circulating most of the hot air in the circulating path around the position of such heating elements and the feeding path of the recording paper. As a result, along the fixation of ink liquid, the moisture contained in the circulating hot air becomes only higher increasingly. Therefore, dew condensation takes place in the ink fixing apparatus after it has been used for a long time. There is thus a possibility that electrical components are damaged, and that dew droplets fall off to the surface of the paper after recording, and stain the recorded images, among other disadvantages.

The hot plate heating method in which a recording paper is in contact with a hot plate may scorch the recording paper if the temperature of the hot plate is too high. Therefore, it is difficult for this method to give heat to the paper rapidly. Hence the time required for the fixation cannot be made shorter. In addition, there is a problem that uneven fixation often ensues because of the unstable contact between the hot plate and the recording paper.

The hot air heating method in which hot air is blasted onto a recording paper requires a measure for the diffusion of vapor contained in the hot air in order to prevent dew condensation. Also, a large electric power is inevitably required to obtain a sufficient accelerating effect of fixation, leading to extremely high costs.

The radiant heat method using an infrared heater makes it difficult to appropriately control the quantity of heat generated by the infrared heater. If the quantity of heat given to a recording paper is too large, scorching takes place. If it is too small, the fixation becomes insufficient. Also, there is a disadvantage that cooling means should be provided for the infrared heater itself in order to prevent its overheating.

SUMMARY OF THE INVENTION

In consideration of the problems encountered in the conventional techniques described above, the present invention is designed. It is an object of the invention to provide an ink liquid fixing device and an ink jet recording apparatus, capable of fixing ink rapidly at lower running costs without any fear of scorching to occur on a recording paper or any fear of uneven fixation and dew condensation to be generated.

It is another object of the invention to provide an ink liquid fixing device and an ink jet recording apparatus, having heating means arranged therefor to heat a recording paper being fed along a given feeding path, such heating means comprising:

- a heat generating element arranged to face the recording paper; and
- means for generating hot air by causing the atmosphere around the heat generating element to flow forcibly, and then, exhausting forcibly the hot air thus generated rapidly.

It is still another object of the invention to provide an ink liquid fixing device and an ink jet recording apparatus, capable of fixing ink on a recording paper evenly in a short period of time by heating the recording paper by use of both radiant heat and hot air for the effective utilization of energy of the heat generating elements to carry out an extremely rapid heating of the recording paper, and also, capable of preventing the surrounding devices from being contaminated due to the formation of any dew condensation by rapidly exhausting the hot air blasted onto the recording paper.

It is a further object of the invention to provide an ink liquid fixing device used for an ink jet recording apparatus that discharges ink liquid onto a recording medium arranged on a given feeding path for the formation of images on such recording medium, the fixing apparatus including the following:

- a housing;
- a first aperture for inducing air into the housing;
- a second aperture having the width of the aperture wider than that of the recording medium arranged on the feeding path, this second aperture being arranged to face the recording surface of the recording medium arranged on the feeding path with given gaps formed between them on the upstream and downstream sides, respectively, in the feeding direction of the recording medium;
- a heat emitting source facing the recording surface of the recording medium arranged on the feeding path through the second aperture;

side portions arranged on the circumference of the heat emitting source, with the first aperture being arranged on one end thereof, and the second aperture on the other end thereof; and exhaust means for inducing the air outside the housing into the housing through the first aperture to guide the air to the recording surface of the recording medium arranged on the feeding path by way of the heat emitting source and the second aperture, and exhausting the air outside the housing by forming the air flow through the aforesaid gaps toward the upstream and downstream sides in the feeding direction of the recording medium.

It is still a further object of the invention to provide an ink jet recording apparatus that records by discharging ink liquid onto a recording medium for the formation of images on the recording medium arranged on a given feeding path, including the following:

a head holding unit for an ink jet head to discharge ink liquid; and an ink liquid fixing device arranged on the downstream side of the head holding unit in the feeding direction of the recording medium, this ink liquid fixing device comprising:

a housing;

a first aperture for inducing air into the housing;

a second aperture having the width of the aperture wider than that of the recording medium arranged on the feeding path, this second aperture being arranged to face the recording surface of the recording medium arranged on the feeding path with given gaps formed between them on the upstream and downstream sides, respectively, in the feeding direction of the recording medium;

a heat emitting source facing the recording surface of the recording medium arranged on the feeding path through the second aperture;

side portions arranged on the circumference of the heat emitting source, with the first aperture being arranged on one end thereof, and the second aperture on the other end thereof; and exhaust means for inducing the air outside the housing into the housing through the first aperture to guide it to the recording surface of the recording medium arranged on the feeding path by way of the heat emitting source and the second aperture, and exhausting it outside the housing by forming the air flow through the aforesaid gaps toward the upstream and downstream sides in the feeding direction of the recording medium.

DETAILED DESCRIPTION OF THE PREFERRED EMBODIMENTS

Hereinafter, with reference to the accompanying drawings, the description will be made of each of the embodiments in accordance with the present invention.

The recording apparatus given below is an ink jet type recording apparatus (ink jet recording apparatus) that executes recording by holding an ink jet recording head on a head holding unit to record by discharging ink from ink discharge ports of the head onto a recording medium. Recording by use of an ink jet recording head of the kind is characterized in that highly precise color images are obtainable at high speeds with lesser noises at lower running costs. Further, as ink discharge energy generating elements, electrothermal transducing elements or electromechanical transducing elements are usable for this type of recording head. Particularly, the one that uses electrothermal transducing elements can be fabricated more compactly by the utilization of the manufacturing processes of semiconductors.

Here, for the present embodiment, the so-called serial type ink jet recording apparatus is exemplified for the description of the present invention. However, the present invention demonstrates its effect most significantly not only for this type, but also for an ink jet recording apparatus arranged to hold on its head holding unit the so-called full line type ink jet head where many numbers of ink discharge ports arranged over the entire width of a recording paper in a direction intersecting the feeding; direction of the recording paper, that is, the direction substantially orthogonal to the feeding direction thereof, for example, and also, for an apparatus that holds on its head holding unit each of full line ink jet heads for use of each of ink, yellow, magenta, cyan, and black inks, arranged in that order in the feeding direction of a recording paper. This is possible because of the fact that with the full line ink jet head, recording is made in a length equivalent to the entire width of a recording paper just by one-time ink discharges from the entire discharge ports, thus obtaining a faster recording speed. Meanwhile, however, there is a need for the rapid ink fixation. Further, in the case of recording images in full color, the amount of ink adhesion becomes greater because discharged ink of each color is superposed on the recording paper, necessitating much faster ink fixation after recording is made in colors.

Figure 1:
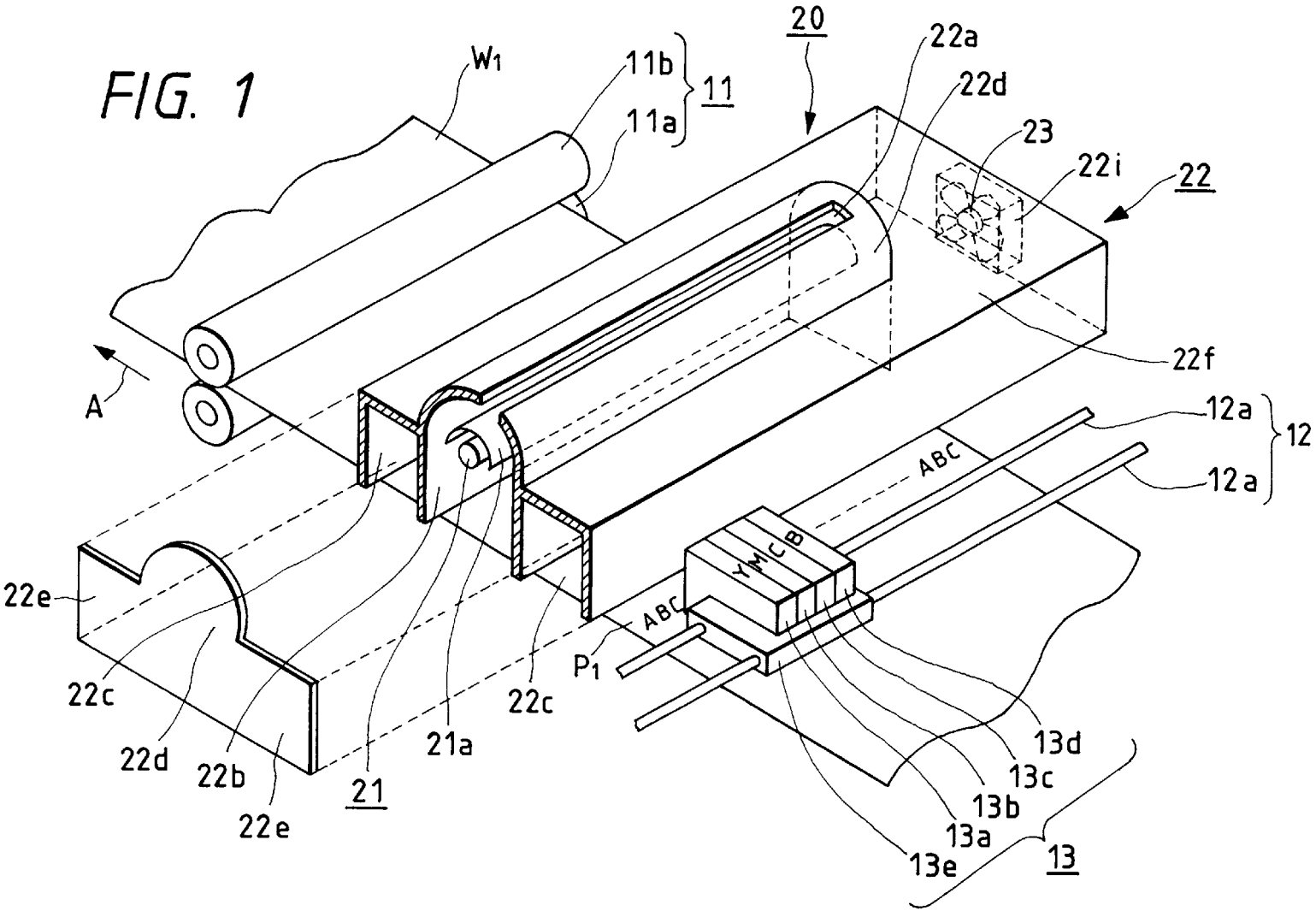
FIG. 1 is a partial perspective view which shows the principal part of an ink jet recording apparatus in accordance with an embodiment of the present invention.

FIG. 1 is a perspective view which shows the principal part of an ink jet recording apparatus in accordance with a first embodiment in a state that a part thereof is cut off. This principal part comprises a feeding device 11 that feeds a recording paper $W_1$ in the direction indicated by an arrow. A along a given feeding path; a recording head unit 13 serving as recording liquid discharge means, which enables the ink jet head to reciprocate along a guide member 12 formed by a pair of guiding rods 12*a* crossing the feeding path; and a fixing acceleration unit 20 serving as heating means, which is arranged between the feeding device 11 and guide member 12. The feeding device 11 is provided with a feed roller 11*a* driven by a motor (not shown) and a pressure roller 11*b* pressed, to the recording paper $w_1$. Also, the recording head unit 13 drives a carriage 13*e* with recording heads 13*a* to 13*d* mounted thereon for use of each of four colors, yellow, magenta, cyan, and black, by means of a driving device (not shown) so as to drive them to reciprocate along the guiding rods 12*a*. Thus prints $P_1$ are recorded on the recording paper $W_1$ by use of recording liquid (ink) discharged from each of the recording heads 13*a* to 13*d*.

The fixing acceleration unit 20 is to accelerate the fixation of the prints $P_1$ by warming the recording paper $W_1$ having the prints $P_1$ recorded on it by the application of both radiant heat and hot air, and comprises an infrared heater 21 serving as a heat generating element to give heat to the recording paper $W_1$ by the application of radiant heat; a hood 22 surrounding the infrared heater 21; and a fan 23 serving as exhaust means for exhausting the hood 22. The hood 22 and fan 23 constitute hot air generating means for causing the air, that is, the atmosphere surrounding the infrared heater 21, to be forced to flow toward the recording paper $W_1$ for the generation of the hot air.

The infrared heater 21 is arranged to face a suction inlet 22*a*, and as shown in FIG. 1, the upper half of the heater is covered by a reflection plate 21*a* whose surface is concave to serve as reflecting means. The reflection plate 21*a* is formed by a stainless steel plate bent semi-cylindrically with its inner surface being mirror finished or the like, for example.

The reflection plate 21*a* serves to reflect the radiant heat emitted upward from the infrared heater 21 toward the recording paper $W_1$, and at the same time, to prevent the infrared heater 21 from being cooled rapidly by the direct contact of the air to be induced into the hood 22 from the suction inlet 22*a* of the hood 22 as described later.

As the infrared heater 21, any one of the known heaters that emit far infrared radiation is optimally adaptable, but the present invention is not necessarily limited thereto. Also, it may be possible to omit the provision of the reflection plate 21*a* if only the output of an infrared heater 21 is sufficient for the intended use and a countermeasure is taken effectively to prevent its cooling or the like due to the air flowing into the hood 22.

The hood 22 comprises an intake duct 22*b* having an arched top to surround the infrared heater 21 and reflection plate 21*a*, and a pair of exhaust ducts 22*c* arranged on both sides of the intake duct 22*b* adjacent thereto. Each end of the intake duct 22*b* is closed by use of an end plate 22*d* whose top is, made semicircular. In this respect, the hood 22 shown in FIG. 1 is in a state that the intake duct 22*b* and exhaust ducts 22*c* are partly cut off in the front on the left side in FIG. 1.

The end of each of the exhaust ducts 22*c* in the front on the left side in FIG. 1 is closed by an end plate 22*e* integrally formed with the end plate 22*d* of the intake duct 22*b* in the front on the left side in FIG. 1. The other ends of the exhaust ducts 22*c* are open to an exhaust chamber 22*f* (see FIG. 1) arranged behind the intake duct 22*b* in the rear on the right side in FIG. 1.

Figure 2:
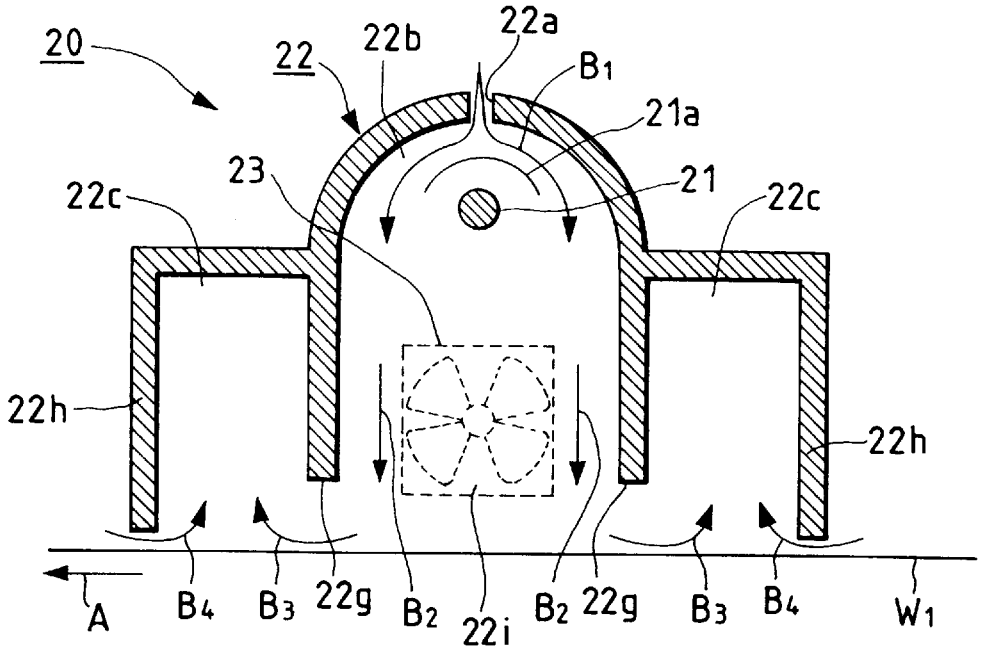
FIG. 2 is a cross-sectional view schematically showing the fixation accelerating unit of the apparatus represented in FIG. 1.

Also, as shown in FIG. 2, the lower ends of side plates 22*g* of the intake duct 22*b* are set away from the surface of the recording paper $W_1$ by a predetermined distance in the width direction of a recording paper $W_1$ in order to form gaps that allow the intake duct 22*b* to be conductively connected with both of the exhaust ducts 22*c*. In this respect, the gaps between the lower end position of the side plates 22*g* of the intake duct 22*b* and the surface of the recording paper $W_1$ are larger than the gaps between the lower end position of the end plates 22*d* of the intake duct 22*b* and the lower end position of the outer wall side plates 22*h* of the exhaust duct 22*c*, and the surface of the recording paper $W_1$. The gaps between the lower end position of the end plates 22*d* and the lower end position of the outer wall side plates 22*h* of the exhaust duct 22*c*, and the surface of the recording paper should be arranged within the closest possible range but not in contact with the surface of the recording paper $W_1$. In other words, the gaps should be set each at approximately 10 mm or less, for example, between the side plates 22*h* and the surface of the recording paper $W_1$.

The exhaust chamber 22*f* is arranged in a location away at least from the position where the hood 22 faces the recording paper $W_1$ to be fed. This chamber is to create negative pressure to suck the air in the intake duct 22*b* into the exhaust chamber 22*f* side through the lower ends of the side plates 22*g* of the intake duct 22*b* and also, through the gaps between the lower ends of side plates 22*g* of the intake duct 22*b*, and the surface of the recording paper. To create such negative pressure, an aperture 22*i* is arranged on one wall surface of the exhaust chamber 22*f* for exhaust use, and the fan 23 is installed in it. It is desirable to exhaust the air from the exhaust aperture 22*i* to the outside of an ink jet recording apparatus as quickly as possible. For that matter, it is also desirable to arrange another aperture for exhaust use on the housing of the recording apparatus in a position opposite and close to the exhaust aperture 22*i* of the chamber.

In this way, the air sucked from the suction inlet 22*a* to the intake duct 22*b* is guided downward all around along the side faces 22*d* and 22*g* in the intake duct 22*b* while being warmed by means of the infrared heater 21, thus being in contact with the surface of a recording paper $W_1$ almost vertically to accelerate the fixation of ink liquid adhering to the surface of the recording paper $W_1$. The air that contains vapor generated along the progress of the ink liquid fixation is being sucked in the exhaust ducts 22*c* through the gaps described earlier as indicated by arrows $B_3$ in FIG. 2, and exhausted to the outside of the hood 22 through the exhaust aperture 22*i* of the exhaust chamber 22*f* by use of the fan 23. At this juncture, most of the air exhausted from the lower end of the intake duct 22*b* is blown out to the downstream side in the feeding direction of the recording paper through the gap between the lower end position of the side plates 22*g* and the surface of the recording paper $W_1$, that is, the gap between the lower end of the side plate 22*g* on the upstream side in the feeding direction of the recording paper, and also, to the upstream side in the feeding direction of the recording paper through the gap between the lower end of the side plate 22*g* on the downstream side in the feeding direction of the. recording paper. Further, an extremely slight portion of the air exhausted from the lower end of the intake duct 22*b* is blown out from the intake duct 22*b* for exhaust through the lower ends of the end plates 22*d* of the intake duct 22*b*.

In this way, the radiant heat and hot air from the infrared heater 21 can accelerate the fixation of ink liquid from above almost all over the recording surface of a recording paper $W_1$. At the same time, the air containing moisture is exhausted rapidly out of the area where the fixation has been accelerated.

Meanwhile, the air outside the hood 22, which is not warmed by the infrared heater 21, flows into the exhaust ducts 22*c* slightly (as indicated by a reference mark $B_4$) through the gaps between the lower end position of the outer wall side plates 22*h* of the exhaust ducts 22. However, this flow of air $B_4$ is blocked by the respective air flow $B_3$ from the intake duct 22*b*, and do not enter the intake duct 22*b*. As a result, there is no possibility that the warmed air in the intake duct 22*b* is cooled by this flow of air from the outside.

In accordance with the present embodiment, the air is guided to blow onto the surface of a recording paper $W_1$ from the position of the infrared heater 21 facing the recording paper, and then, exhausted rapidly, thus making it possible to conduct ink fixation efficiently by the application of radiant heat and hot air, and to exhaust the air that contains moisture without using it again for the ink fixation at the same time. It is thus possible to prevent the dew condensation from taking place in the fixing apparatus by the generation of vapor along with the ink fixation, particularly after its operation is suspended.

The recording paper is heated by blowing the air warmed by means of an infrared heater onto the recording paper at the same time of the recording paper being heated by the application of radiant heat from the infrared heater. Therefore, it is possible to utilize the output of the infrared heater extremely effectively for heating the recording paper, and fixing the prints on it rapidly. In other words, while obtaining a sufficient accelerating effect of fixation, it is possible to make its running costs lower.

Also, by means of the air flowing around the infrared heater, it is possible to prevent it from being overheated. Therefore, there is no possibility that the recording paper is scorched even if the output of the infrared heater is increased in order to make the fixing speed faster.

Since the infrared heater itself is cooled by the air flowing around it, there is no need for the extra provision of any cooling means for preventing overheating of the infrared heater.

Further, there is no fear that uneven fixation takes place as in the case of the hot plate heating method because this method uses the radiant heat method and hot air heating method in combination.

In this way, it is possible to prevent the diffusion of the vapor generated at the time of fixing ink adhering to a recording paper $W_1$. The vapor is forcibly exhausted together with the air in the exhaust ducts, thus avoiding any trouble that may ensue if dew condensation occurs.

Figure 3:
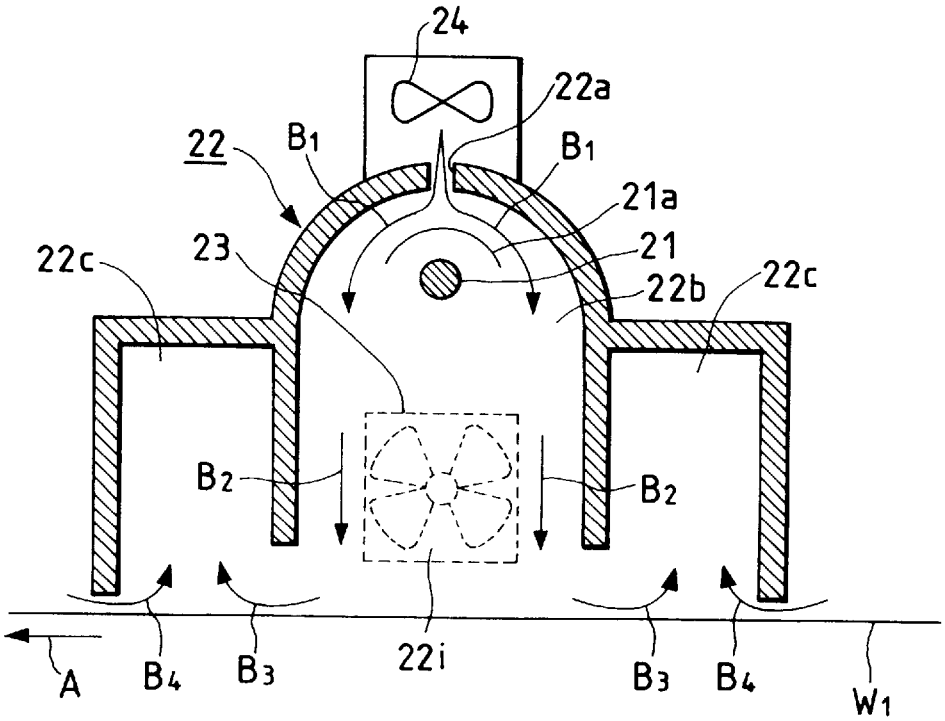
FIG. 3 is a cross-sectional view schematically showing one example of the variation of the apparatus represented in FIG. 2.

In this respect, if a second fan is installed on the upstream side of the suction inlet 22*a* of the hood 22, as shown in FIG. 3, serving as ventilating means for increasing the amount of air to be sucked from the suction inlet 22*a* to the intake duct 22*b*, it is possible to increase the fixing speed more by blowing a larger amount of hot air onto a recording paper $W_1$. Also, with a structure having only the fan 24 without the provision of the fan 23, it is possible to guide the hot air by way of the position of the infrared heater 21→ the surface of the recording paper→ the exhaust aperture 22*i*, although the efficiency of moisture exhaust is slightly lowered as compared to the structure arranged by the aforesaid fan 23 alone or the structure arranged with the combination of the fan 23 and the fan 24.

Figure 4:
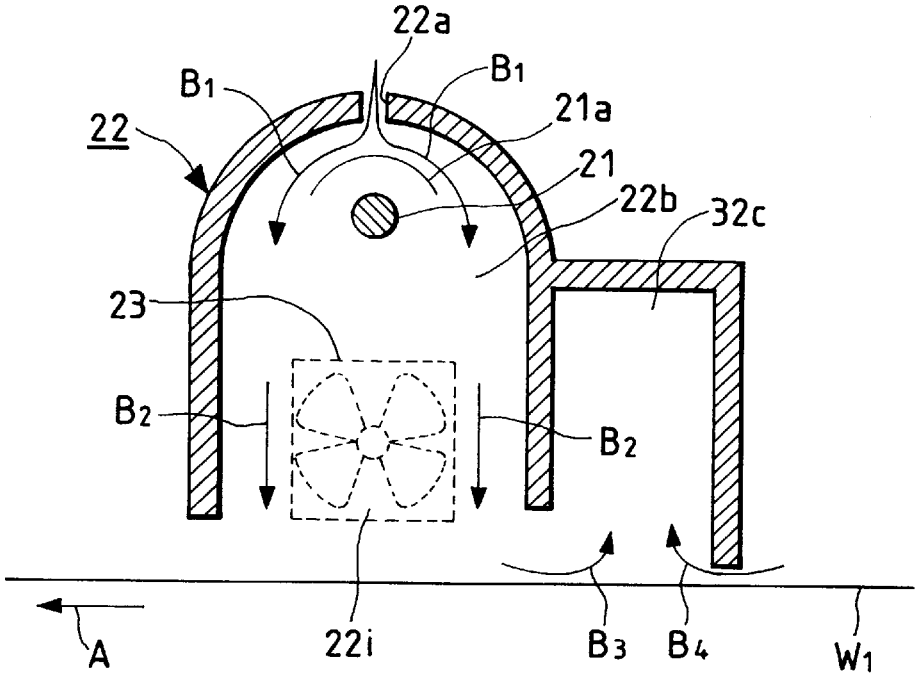
FIG. 4 is a cross-sectional view schematically showing one example of another variation of the apparatus represented in FIG. 2.
Figure 5:
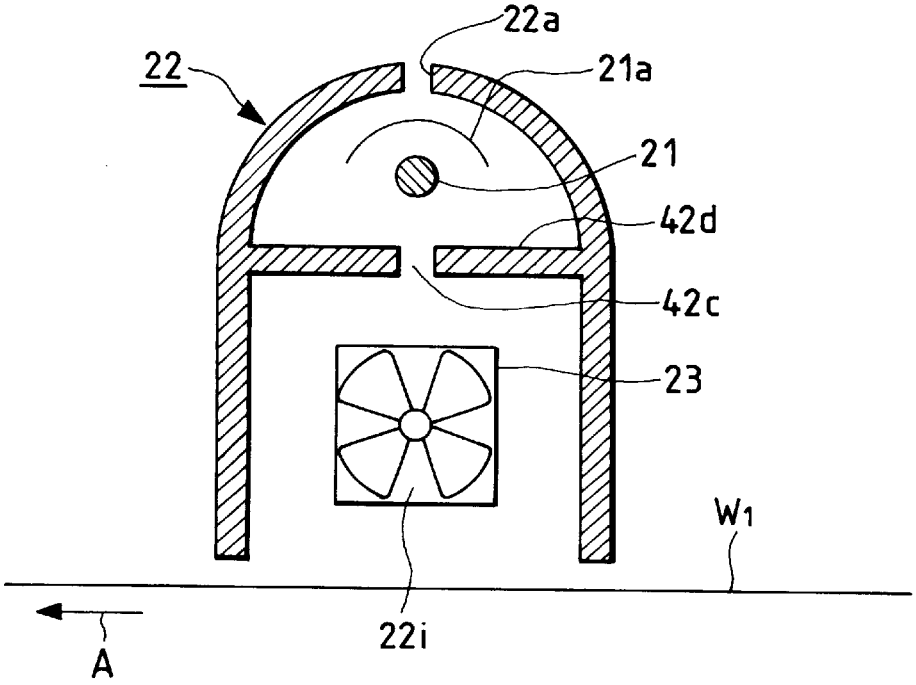
FIG. 5 is a cross-sectional view schematically showing one example of still another variation of the apparatus represented in FIG. 2.

Also, by simplifying the structure of the hood 22 in such a manner that an exhaust duct 32*c* is installed only on one side of the intake duct 22*b* as shown in FIG. 4 or the interior of the intake duct 22*b* is divided into the upstream side and downstream side by use of a partition wall 42*d* having an aperture 42*c* so as to use the downstream side as an exhaust duct as shown in FIG. 5, it is significantly useful for making the apparatus smaller and reducing costs accordingly.

Figure 6:
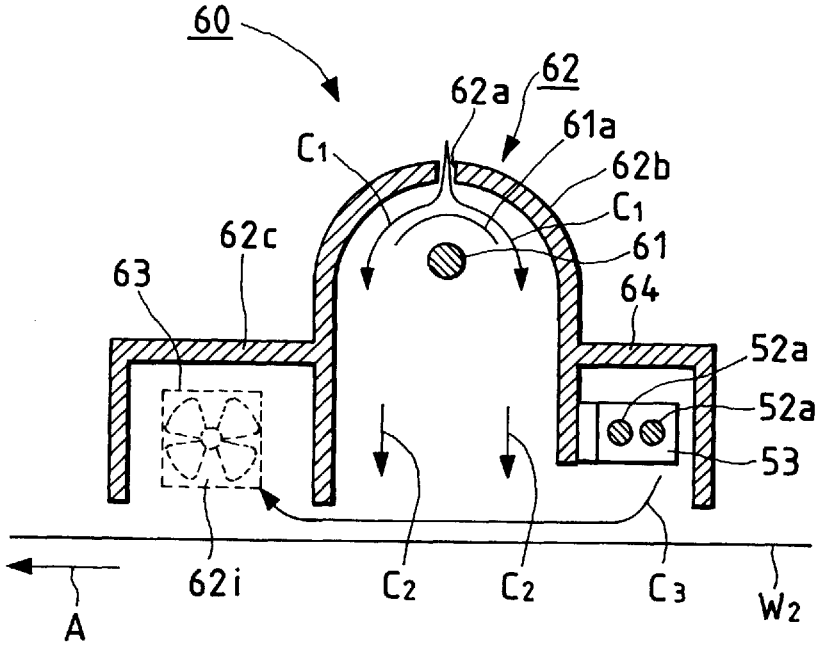
FIG. 6 is a cross-sectional view partially showing the fixation acceleration unit of an ink jet recording apparatus in accordance with a second embodiment of the present invention.

FIG. 6 is a view which shows a fixing acceleration unit 60 serving as heating means in accordance with a second embodiment of the present invention. This unit comprises an intake duct 62*b* arranged in the same manner as the intake duct 22*b* of the hood 22 represented in FIG. 1; an exhaust duct 62*c* adjacent to one side of the intake duct 62*b*; and a hood 64 arranged at the opposite side thereof, which is provided with a recording head cover 64 serving as guiding means adjacent to the intake duct 62*b*. A fan 63 is installed on the rear end of the exhaust duct 62*c*, which serves as exhaust means. The recording head cover 64 surrounds a recording section that can include, for example, a recording head unit 53 that reciprocates along a pair of guide rods 52*a*.

In the intake duct 62*b* of the hood 62, there are arranged an infrared heater 61 and a reflection plate 61*a*, serving as a heat generating element. The recording paper $W_2$ having images on it recorded by each of the recording heads of the recording head unit 53 is heated both by the application of radiant heat of the infrared heater 61 and the hot air flowing as indicated by arrows $C_2$ by the suction of the intake duct 62*b* as indicated by arrows $C_1$ and heated by means of the infrared heater 61, thus the fixation of ink being accelerated.

At the same time, the atmospheric air in the recording head cover 64 is being heated by the heat generated by the recording head unit 53, and then, sucked into the intake duct 62*b* as indicated by an arrow $C_3$ to heat the recording paper $W_2$ together with the aforesaid hot air, thus accelerating the fixation of ink.

In accordance with the present embodiment, the heat generated by the recording head can be utilized efficiently. In addition to it, the recording head is cooled effectively to obtain its stable discharge of droplets.

Any other points are the same as those of the first embodiment. Therefore, the description thereof will be omitted.

Figure 7:
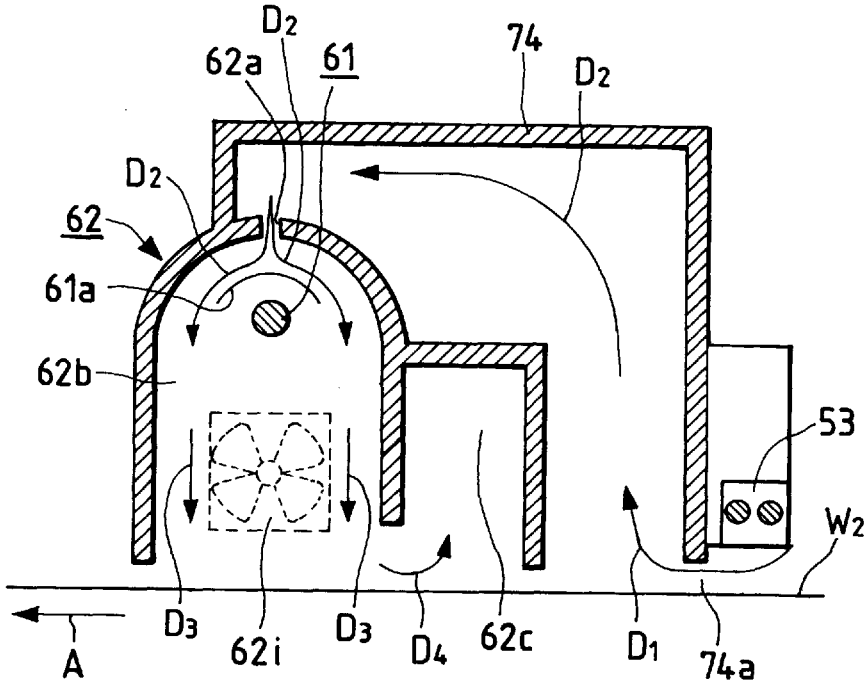
FIG. 7 is a cross-sectional view schematically showing one example of the variation of the apparatus represented in FIG. 6.

In this respect, as shown in FIG. 7, it may be possible to install the exhaust duct 62*c* of the hood 62 on the upstream side of the intake duct 62*b*, and at the same time, to install an intake cover 74 that surrounds the intake duct 62*b* and exhaust duct 62*c* instead of the recording head cover 64, while arranging the aperture 74*a* of the intake cover 74 near the recording head unit 53 of the recording section. In this case, the recording head unit 53 of the recording section is cooled by the air being sucked in by the intake cover 74 as indicated by an arrow $D_1$. In this way, the heated air is sucked from the suction inlet 62*a* into the intake duct 62*b* as indicated by an arrow $D_2$. Thus, the heated air is blown to a recording paper $W_2$ as indicated by arrows $D_3$ and then, inducted to flow in the exhaust duct 62*c* as indicated by an arrow $D_4$.

Any other points are the same as those of the first embodiment. Therefore, the description thereof will be omitted.

Figure 8:
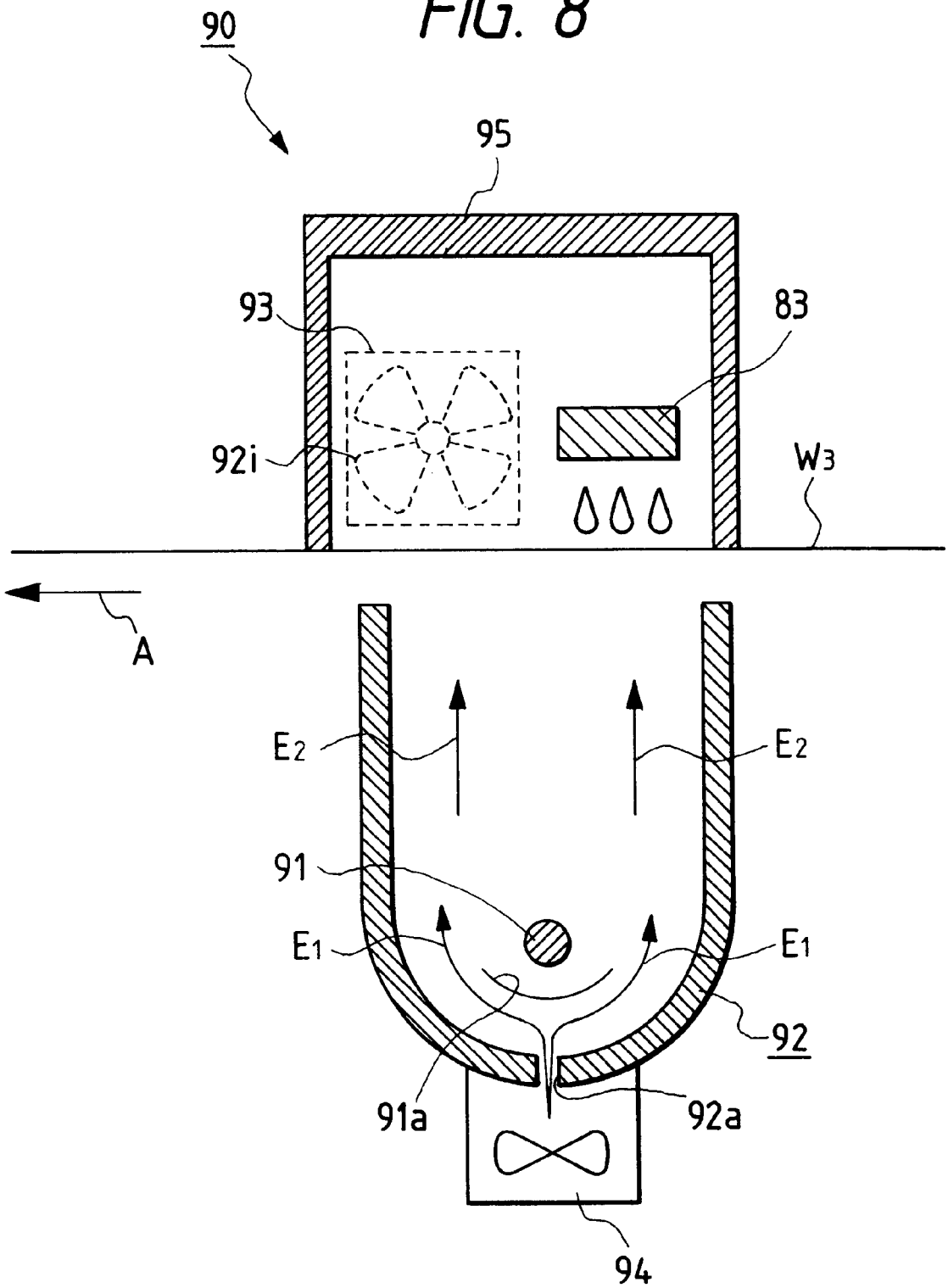
FIG. 8 is a cross-sectional view schematically showing the fixation acceleration unit of an ink jet recording apparatus in accordance with a third embodiment of the present invention.

FIG. 8 is a view which shows a fixing acceleration unit 90 serving as heating means in accordance with a third embodiment of the present invention. This unit is provided with a heating hood 92 underneath a recording paper $W_3$ that is being fed as in the first embodiment. This is a hood that heats up the recording paper $W_3$ from its lower face by the application of both radiant heat and hot air. Above the recording paper $W_3$, an exhaust duct 95 is installed to serve as a second hood that forcibly exhausts the vapor to be generated from ink.

The heating hood 92 is provided with a fan 94 serving as ventilating means for sending air through inlet 92*a*. In the heating hood 92, there are arranged an infrared heater 91 and a reflection plate 91*a*, which are the same heat generating element formed by the infrared heater 21 and reflection plate 21*a* of the first embodiment.

Also, the exhaust duct 95 is provided with a second fan 93 to exhaust the atmospheric air from the interior of the duct. This duct is arranged to surround the recording head unit 83 and the printed portion of a recording paper $W_3$ on the downstream side of the head unit.

As indicated by an arrow $E_1$, the air flowing from the inlet 92*a* into the heating hood 92 is being heated by the infrared heater 91, and blown to the back face of the recording paper $W_3$ as indicated by an arrow $E_2$.

In this way, the recording paper $W_3$ is heated rapidly by the application of both radiant heat and hot air thus generated by the infrared heater 91 so as to fix ink on the recording paper $W_3$ quickly.

On the other hand, the vapor generated from the prints on the recording paper $W_3$ is exhausted smoothly together with the air in the exhaust duct 95 by use of the fan 93. Therefore, there is no. fear that any dew condensation takes place.

In accordance with the present embodiment, it is possible to heat a recording paper from its back face while in recording by means of the recording head unit. Therefore, the fixing speed can be made faster still in addition to an advantage that an excellent cooling effect is obtainable with respect to the recording head unit. A reference numeral 92*i* denotes an exhaust opening or aperture.

Any other points are the same as those of the first embodiment. Therefore, the description thereof will be omitted.

With each of the structures set forth above in accordance with each of the aforesaid embodiments, it is possible to implement an ink jet recording apparatus capable of heating a recording paper rapidly to fix ink on it quickly at lower running costs without any fear that the recording paper is scorched, uneven fixation takes place, and dew condensation occurs, as a significant effect that each of the embodiments can demonstrate as described above.

What is claimed is:

1. An ink jet recording apparatus for recording on a recording medium disposed at a conveyance route by discharging ink from an ink jet head to the recording medium, said apparatus comprising:

a hot air generating duct for generating hot air to fix ink liquid deposited on the recording medium after ink jet recording, said hot air generating duct having a first opening for introducing air from an exterior of said hot air generating duct into an interior thereof, a second opening opposed to the conveyance route and along the conveyance route, a heat generating source provided between said first and second openings and opposed to the conveyance route and a heat reflecting member provided between said heat generating source and said first opening to reflect the heat generated by said heat generating source;

an air exhausting duct disposed adjacent to said hot air generating duct to exhaust through a vicinity of the conveyance route a gas having flowed from said second opening to the conveyance route, said exhausting duct having a third opening facing the conveyance route and a fourth opening for exhausting the gas in said exhausting duct to the exterior thereof;

gas flow generating means for generating a gas flow from said first opening through said second and third openings to said fourth opening;

a housing defining said hot air generating duct and said air exhausting duct, said housing having a partition side plate disposed between said second and third openings which are opposed to the conveyance route and an end plate of said air exhausting duct, said partition side plate and said end plate being disposed to maintain gaps relative to the conveyance route; and a hood disposed adjacent said housing for covering the ink jet head, said hood having a fifth opening opposed to the conveyance route and along the conveyance route.

2. An ink jet recording apparatus according to claim 1, wherein said reflecting member reflects radiant heat from said heat generating source to a recording surface side of the recording medium located in the conveyance route.

3. An ink jet recording apparatus according to claim 1, further comprising said ink jet head, said ink jet head having electrothermal transducing elements for discharging the ink by use of thermal energy generated by said electrothermal transducing elements.

4. An ink jet recording apparatus according to claim 3, wherein said housing is disposed downstream of said ink jet head in the conveyance route.

5. An ink jet recording apparatus according to claim 3, wherein at least a portion of the gas flow moves perpendicularly to the conveyance route at the exit of said second opening.

6. An ink jet recording apparatus according to claim 3, wherein said heat generating source generates infrared radiation.

7. An ink jet recording apparatus according to claim 1, wherein said hood is disposed upstream of said housing in the conveyance route.

8. An ink jet recording apparatus according to claim 1, wherein said hood is formed integrally with said housing.

9. An ink jet recording apparatus according to claim 1, wherein the gap between said end plate and the conveyance route is smaller than the gap between said partition side plate and the conveyance route.

10. An ink jet recording apparatus according to claim 1, further comprising a hood partition plate between said housing and said hood, wherein a gap between said hood partition plate and the conveyance route is greater than the gap between said partition side plate and the conveyance route.

11. An ink jet recording apparatus according to claim 1, further comprising a hood partition plate between said housing and said hood, wherein a gap between said hood partition plate and the conveyance route is greater than a gap between walls of said hood and the conveyance route.

12. An ink jet recording apparatus according to claim 1, wherein said gas flow generating means further generates a gas flow of heated air from within said hood, across the conveyance route and out said air exhausting duct.

13. An ink jet recording apparatus for recording on a recording medium disposed at a conveyance route by discharging ink from an ink jet head to the recording medium, said apparatus comprising:

a hot air generating duct for generating hot air to fix ink liquid deposited on the recording medium after ink jet recording, said hot air generating duct having a first opening for introducing air from an exterior of said hot air generating duct into an interior thereof, a second opening opposed to the conveyance route and along the conveyance route, a heat generating source provided between said first and second openings and opposed to the conveyance route and a heat reflecting member provided between said heat generating source and said first opening to reflect the heat generated by said heat generating source;

an air exhausting duct disposed adjacent to said hot air generating duct to exhaust through a vicinity of the conveyance route a gas having flowed from said second opening to the conveyance route, said exhausting duct having a third opening facing the conveyance route and a fourth opening for exhausting the gas in said exhausting duct to the exterior thereof;

an air intake duct communicating with the first opening for supplying the air from the exterior to the first opening, said air intake duct having a fifth opening opposed to the conveyance route and along the conveyance route;

gas flow generating means for generating a gas flow from said first opening through said second and third openings to said fourth opening; and a housing defining said air intake duct, said hot air generating duct and said air exhausting duct, said housing having a partition side plate disposed between said second and third openings which are opposed to the conveyance route and an end plate of said air exhausting duct, said partition side plate and said end plate being disposed to maintain gaps relative to the conveyance route.

14. An ink jet recording apparatus according to claim 13, wherein said reflecting member reflects radiant heat from said heat generating source to a recording surface side of the recording medium located in the conveyance route.

15. An ink jet recording apparatus according to claim 13, further comprising said ink jet head, said ink jet head having electrothermal transducing elements for discharging the ink by use of thermal energy generated by said electrothermal transducing elements.

16. An ink jet recording apparatus according to claim 15, wherein said housing is disposed downstream of said ink jet head in the conveyance route.

17. An ink jet recording apparatus according to claim 13, wherein at least a portion of the gas flow moves perpendicularly to the conveyance route at the exit of said second opening.

18. An ink jet recording apparatus according to claim 13, wherein said heat generating source generates infrared radiation.

19. An ink jet recording apparatus according to claim 13, wherein said air intake duct surrounds said air exhausting duct.

20. An ink jet recording apparatus according to claim 13, wherein said intake duct is disposed upstream of said hot air generating duct in the conveyance route.

21. An ink jet recording apparatus according to claim 20, wherein said air exhausting duct is disposed between said air intake duct and said hot air generating duct.

22. An ink jet recording apparatus according to claim 13, wherein a gap between an upstream edge of said air intake duct and the conveyance route is greater than a gap between an upstream edge of said air exhausting duct and the conveyance route.

23. An ink jet recording apparatus according to claim 13, further comprising mounting means for mounting the ink jet head, said mounting means being disposed on an upstream side of said air intake duct in the conveyance route.

24. An ink jet recording apparatus according to claim 23, wherein said gas flow generating means further generates a gas flow of heated air from the upstream side of said air intake duct, across the conveyance route and through said air intake duct to said hot air generating duct.

25. An ink jet recording apparatus according to claim 13, wherein the gap between said end plate and the conveyance route is smaller than the gap between said partition side plate and the conveyance route.

26. An ink jet recording apparatus for recording on a recording medium disposed at a conveyance route by discharging ink from an ink jet head to the recording medium, said apparatus comprising:

a hot air generating duct for generating hot air to fix ink liquid deposited on the recording medium after ink jet recording, said hot air generating duct having a first opening for introducing air from an exterior of said hot air generating duct into an interior thereof, a second opening opposed to the conveyance route and along the conveyance route, a heat generating source provided between said first and second openings and opposed to the conveyance route and a heat reflecting member provided between said heat generating source and said first opening to reflect the heat generated by said heat generating source;

an air exhausting duct disposed adjacent to said hot air generating duct to exhaust through a vicinity of the conveyance route a gas having flowed from said second opening to the conveyance route, said exhausting duct having a third opening facing the conveyance route and a fourth opening for exhausting the gas in said exhausting duct to the exterior thereof;

gas flow generating means for generating a gas flow from said first opening through said second and third openings to said fourth opening;

a housing defining said hot air generating duct and said air exhausting duct, said housing having a partition side plate disposed between said second and third openings which are opposed to the conveyance route and an end plate of said air exhausting duct, said partition side plate and said end plate being disposed to maintain gaps relative to the conveyance route; and a recording section, including the ink jet head, mounted on an upstream side of said housing relative to the conveyance route, wherein said gas flow generating means further generates a gas flow of heated air from said recording section and out said air exhausting duct.

27. An ink jet recording apparatus according to claim 26, wherein ambient air is introduced directly into said first opening of said hot air generating duct.

* * * * *

UNITED STATES PATENT AND TRADEMARK OFFICE

CERTIFICATE OF CORRECTION

PATENT NO. : 6,439,712 B1
DATED : August 27, 2002
INVENTOR(S) : Mizutani et al.

It is certified that error appears in the above-identified patent and that said Letters Patent is hereby corrected as shown below:

Title page,
Item [56], References Cited, FOREIGN PATENT DOCUMENTS, "2251453" should read -- 2-251453 --.

Column 4,
Line 41, "feeding;" should read -- feeding --; and
Line 61, "arrow." should read -- arrow --.

Column 5,
Line 3, "pressed," should read -- pressed --; and
Line 49, "is," should read -- is --.

Column 6,
Line 52, "the." should read -- the --.

Column 7,
Line 62, "42d" should read -- 24d --.

Column 9,
Line 17, "no." should read -- no --.

Column 10,
Lines 21 and 25, "claim 3," should read -- claim 1, --.

Signed and Sealed this

Eleventh Day of March, 2003

JAMES E. ROGAN
*Director of the United States Patent and Trademark Office*